US011679416B1

(12) United States Patent
Obaia et al.

(10) Patent No.: US 11,679,416 B1
(45) Date of Patent: Jun. 20, 2023

(54) SCREEN CLOTHS

(71) Applicant: SYNCRUDE CANADA LTD. in trust for the owners of the Syncrude Project as such owners exist now and in the future, Calgary (CA)

(72) Inventors: Khaled Obaia, Edmonton (CA); Hugh Roth, Edmonton (CA)

(73) Assignee: SYNCRUDE CANADA LTD. in trust for the owners of th, Calgary (CA)

( * ) Notice: Subject to any disclaimer, the term of this patent is extended or adjusted under 35 U.S.C. 154(b) by 0 days.

(21) Appl. No.: 17/737,757

(22) Filed: May 5, 2022

(51) Int. Cl.
*B07B 1/46* (2006.01)

(52) U.S. Cl.
CPC ..... *B07B 1/4618* (2013.01); *B07B 1/4645* (2013.01)

(58) Field of Classification Search
CPC ..... B07B 1/4618; B07B 1/4645; B07B 1/469; B07B 1/4609
USPC ..... 209/363
See application file for complete search history.

(56) References Cited

U.S. PATENT DOCUMENTS 9,149,841 B2 * 10/2015 Ghosh ..... B07B 1/4627
9,724,732 B2 8/2017 Moon et al.
2013/0026080 A1 * 1/2013 Mohanka ..... B07B 1/4609 29/428
2013/0092608 A1 4/2013 Tieu et al.
2016/0038976 A1 2/2016 Moon et al.
2017/0043376 A1 2/2017 Tieu et al.

FOREIGN PATENT DOCUMENTS

CA 2755026 4/2013
CA 2992665 1/2017
DE 3413613 10/1985

* cited by examiner

*Primary Examiner* — Michael McCullough
*Assistant Examiner* — Jessica L Burkman
(74) *Attorney, Agent, or Firm* — Benneii Jones LLP; Irene Bridger

(57) ABSTRACT

A screen cloth for use in a screening device for screening out oversize objects, including oil sands lumps and rocks present in an oil sands slurry is provided, comprising at least one screen segment having a top surface and having a plurality of openings therein; and a plurality of anti-wear tiles attached to the top surface of the at least one screen segment by brazing; whereby each anti-wear tile is separated from an adjacent anti-wear tile by a gap that is about 0.5 mm or less such that a brazing material used to attach the anti-wear tiles to the at least one support structure fills the gap between each anti-wear tile through capillary action thereby connecting each anti-wear tile to its adjacent anti-wear tile.

20 Claims, 9 Drawing Sheets

SCREEN CLOTHS

FIELD OF THE INVENTION

The present invention relates generally to a tiled screen cloth particularly useful for vibrating screens for screening oversize objects in a material such as an oil sand slurry.

BACKGROUND OF THE INVENTION

Vibrating, rotating and/or stationary screens are used in the oil sand industry, in particular, in oil sand slurry preparation plants. Oil sand, such as is mined in the Fort McMurray region of Alberta, generally comprises water-wet sand grains held together by a matrix of viscous bitumen. It lends itself to liberation of the sand grains from the bitumen by mixing or slurrying the oil sand in water, allowing the bitumen to move to the aqueous phase.

As-mined or pre-crushed oil sand is generally mixed with warm or hot water to yield an oil sand slurry. The slurry is then conditioned in a hydrotransport pipeline and subsequently introduced into a large, open-topped, conical-bottomed, cylindrical vessel commonly termed a primary separation vessel (PSV) where the more buoyant aerated bitumen rises to the surface and forms a bitumen froth layer.

It may be desirable to remove the larger aggregates present in oil sand slurry prior to pipelining in order to avoid blockage or damage of downstream equipment, e.g., pump component wear. Thus, vibrating, rotating and/or stationary screens may be used at various points during slurry preparation to reject larger lumps of oil sand, rocks and other aggregates, which are large enough to block or damage downstream equipment, prior to pipeline conditioning. Screens may also be used to further screen oil sand tailings slurry prior to treating/disposing same.

However, oil sand slurry is extremely heavy and abrasive due to the large amount of sand, gravel and crushed rock contained therein. Further, in particular with primary vibrating screens, these screens are generally vibrating with an acceleration of approximately 4-5 g, so that all oil sand slurried material passes over and through the screen cloths of the vibrating screen. This results in the rapid spalling and eventual wearing through of the screen cloths of the vibrating screen ("hole-throughs"), which can lead to production interruption and an unplanned maintenance event.

Recently, the industry has been exploring the attachment of anti-wear tiles, for example, sintered tungsten carbide tiles, to a screen support structure, which is generally made from steel, to improve wear resistance of the screen. Commonly, the individual tiles are spaced apart from one another by a gap of about 1-3 mm. It was previously believed that providing a larger gap between the tiles would protect the tiles from exerting compressive stresses on each other, thereby preventing edge breakage of the tiles. However, it was discovered by the present applicant that having such large gaps between each tile actually significantly increased the stress concentration in the screen support structure at the gap locations. Further, accelerated corrosion of the screen support structure was also observed at the gaps between the tiles. This lead to fatigue cracking/corrosion over time, which ultimately resulted in failure of the screen cloths.

SUMMARY OF THE INVENTION

The current application is directed to screen cloths useful for screening an abrasive slurry such as an oil sand slurry having oversize reject material. Use of the present invention extends the running time of a vibrating screening device so that the operator does not have to shut down the screening device as frequently to replace the impact screen cloths. It is understood, however, that the screen cloths of the present invention can also be used with rotating and/or stationary screening devices.

Broadly stated, in one aspect of the present invention, a screen cloth for use in a screening device for screening out oversize objects, including oil sand lumps and rocks, is provided, comprising:

- at least one screen segment having a top surface and having a plurality of openings therein; and
- a plurality of anti-wear tiles attached to the top surface of the at least one screen segment by brazing;
- whereby each anti-wear tile is separated from an adjacent anti-wear tile by a gap that is about 0.5 mm or less such that a brazing material used to attach the anti-wear tiles to the at least one support structure fills the gap between each anti-wear tile through capillary action, thereby connecting each anti-wear tile to its adjacent anti-wear tile and preventing the formation of a gap or crack between adjacent anti-wear tiles.

In one embodiment, the screen cloth comprises a single screen segment, said screen segment having a perimeter and comprising a plurality of longitudinal ligament and a plurality of transverse ligaments, the longitudinal and transverse ligaments forming the plurality of openings.

In one embodiment, the screen cloth further comprises a support structure, the support structure comprising two mutually opposing lateral attachment elements and a plurality of transverse stiffeners extending therebetween, whereby the at least one screen segment is attached to the support structure to form a screening portion of the screen cloth.

In one embodiment, the support structure comprises a metal plate having a plurality of openings therethrough, whereby more than one screen segment is attached to a front surface of the metal plate such that the openings of the metal plate and the openings of the screen segments are aligned.

In one embodiment, the at least one screen segment is cast or forged from carbon steel, low alloy steel, stainless steel, or other strong material (e.g. nickel or cobalt based alloys). In one embodiment, the anti-wear tiles are comprised of cemented or sintered tungsten carbide.

In one embodiment, the brazing material comprises an alloy comprising aluminum, copper, nickel or silver or combinations thereof.

In another aspect of the present invention, a method is provided for manufacturing a tiled screen segment for a screen cloth for use in a screening device for screening out oversize objects, including oil sand lumps and rocks, comprising:

- providing a screen segment having a top surface;
- arranging a plurality of anti-wear tiles on the top surface of the screen segment such that each anti-wear tile is separated from an adjacent anti-wear tile by a gap of less than about 0.5 mm; and
- brazing the anti-wear tiles to the top surface of the screen segment such that a brazing material fills the gap between each anti-wear tile through capillary action thereby connecting each anti-wear tile to its adjacent anti-wear tile.

Additional aspects and advantages of the present invention will be apparent in view of the description, which follows. It should be understood, however, that the detailed description and the specific examples, while indicating preferred embodiments of the invention, are given by way of illustration only, since various changes and modifications will become apparent to those skilled in the art from this detailed description.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the following figures. It is understood that the drawings provided herein are for illustration purposes only and are not necessarily drawn to scale FIG. 1A (PRIOR ART) shows a screen segment having anti-wear tiles brazed thereon where the gap between tile 1 and tile 2 is between 1-3 mm.

DETAILED DESCRIPTION OF PREFERRED EMBODIMENTS

Figure 1A:
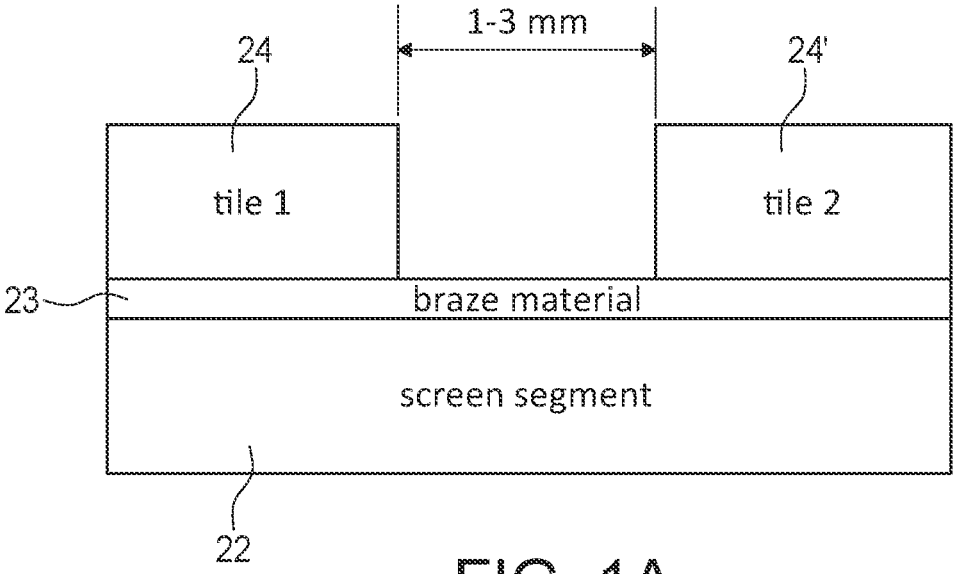
FIG. 1A PRIOR ART
FIG. 1B shows a screen segment of the present invention having anti-wear tiles brazed thereon where the gap between tile 1 and tile 2 is less than 0.5 mm.

The detailed description set forth below in connection with the appended drawings is intended as a description of various embodiments of the present application and is not intended to represent the only embodiments contemplated. The detailed description includes specific details for the purpose of providing a comprehensive understanding of the present application. However, it will be apparent to those skilled in the art that the present application may be practised without these specific details.

The present invention relates generally to a screen cloth with improved wear properties for use in screening raw materials such as crushed oil sand, ores and the like, and, in particular, screening oil sand slurry using a vibrating screening device comprising the screen cloths. Each screen cloth is comprised of at least one screen segment having a plurality of anti-wear tiles, preferably made from cemented or sintered carbide such as cemented or sintered tungsten carbide.

As used herein, "cemented or sintered carbides" are metal matrix composites where carbide particles act as the aggregate and a metallic binder serves as the matrix. They consist of fine particles of carbide cemented into a composite by a binder metal. Cemented carbides commonly use tungsten carbide (WC), titanium carbide (TiC), or tantalum carbide (TaC) as the aggregate.

As used herein, an "anti-wear tile" is a tile that is comprised of a cemented or sintered carbide. An anti-wear tile is preferably made from cemented or sintered tungsten carbide that is comprised of tungsten carbide particles held together by an interpenetrating film of cobalt or cobalt alloy. The various grades of cemented or sintered tungsten carbide depends on the size of the tungsten carbide particles, the percentage of alloy binding phase, and the amount of alloying in the binder phase.

As used herein, "brazing" is a metal-joining process in which two or more metal items are joined together by melting and flowing a filler metal into the joint, with the filler metal having a lower melting point than the adjoining metal. The filler metal is brought slightly above its melting (liquid) temperature. The melted (liquid) filler metal then flows over the base metal (in a process known as wetting) and is then cooled to join the work pieces together. A major advantage of brazing is the ability to join the same or different metals with considerable strength. The filler material forms an interface layer or joining interlayer. In summary, brazing is a metal joining process in which base metals are joined without exceeding their melting temperature using a braze filler metal melted at a temperature above 840° F. Braze filler metals are designed to fit base metal, temperature, connection design, brazing process, and the stress needed to be transmitted.

Suitable brazing materials are aluminum, copper, nickel and sliver, or combinations thereof, with silver alloys being the most versatile.

It was discovered by the present applicant that the spacing between anti-wear tiles from each other (i.e., gap) when brazing the anti-wear tiles onto a structural element was critical for preventing failure of screen cloths. Industry standard was to space these anti-wear tiles between 1-3 mm from each other to provide some "wiggling" of the tiles on the molten braze layer under flame heat. However, failure analysis showed that gaps more than 0.55 mm introduced structural vulnerability and with cyclic loads resulted in high stress concentration in base metal that, together with high fatigue cycle loading, leads to cracks and subsequent failure. Smaller gaps, i.e., 0.5 mm or less, on the other hand, allowed brazed material to fill these gaps, i.e., the distance between tiles, through capillary action and, consequently, eliminating the inherent initial crack and stress concentration. By filing the gaps between tiles with brazed material, this allows the tiles to be directly attached to one another and stiffens the screen cloth as a whole. Consequently, this avoids the stress at the gaps that would otherwise be present if the gaps were larger and unfilled. An additional advantage of filling the gaps with brazed material is that it protects the base (i.e., structural element) from corrosion.

Figure 1B:
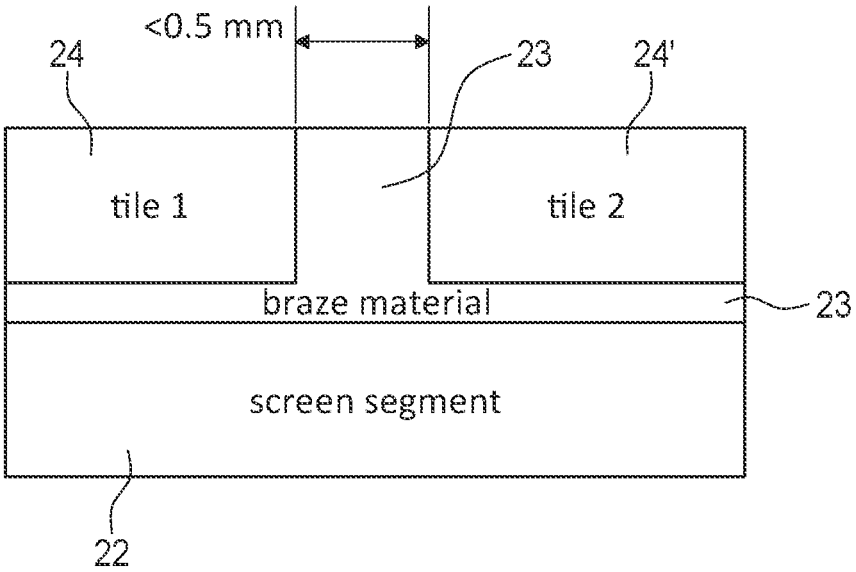

FIG. 1A is a schematic of the prior art brazing of anti-wear tiles 24, 24' to a screen segment 22 using brazing (or braze) material 23, where the gap between the two tiles 24 is between 1-3 mm. As can be seen in FIG. 1A, the gap is not filled with brazing material 23. FIG. 1B shows a segment 22 having a gap between the two tiles 24, 24' of less than about 0.5 mm. In this instance, brazing material 23 fills the gap between the two tiles 24, 24'.

Figure 2:
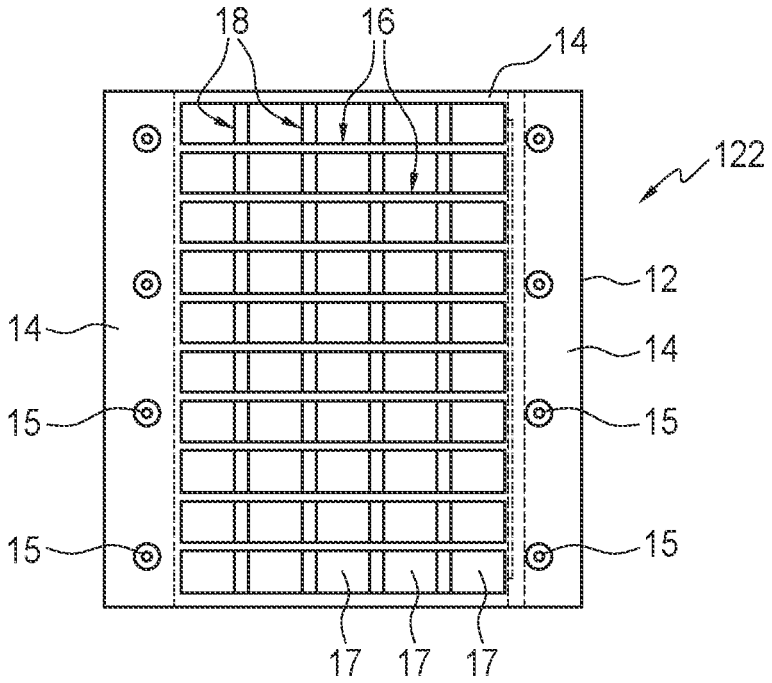
FIG. 2 illustrates one embodiment of a screen segment of the present invention where the screen segment has a perimeter and is comprised of a plurality of longitudinal ligament and a plurality of transverse ligaments, the longitudinal and transverse ligaments forming the plurality of openings.
Figure 3B:
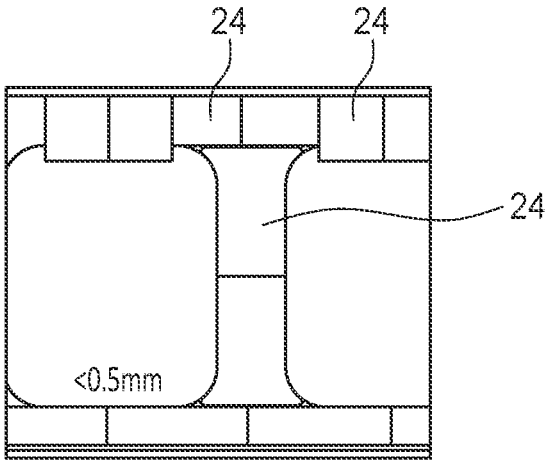
FIG. 3B is an expanded view of the encircled portion of the screen cloth of FIG. 3A showing a plurality of anti-wear tiles are spaced less than 0.5 mm apart.
Figure 3A:
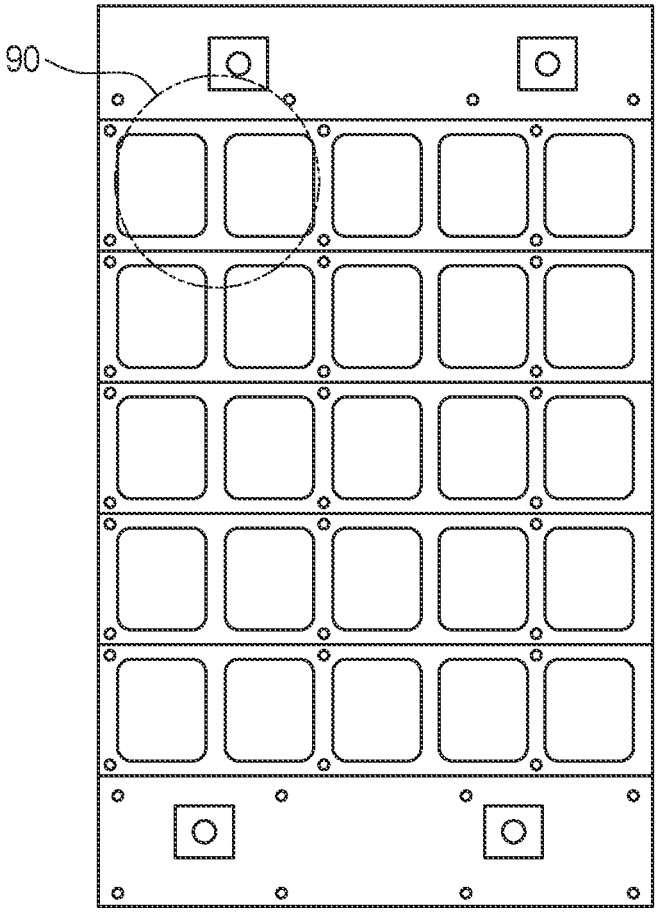
FIG. 3A illustrates the screen segment of FIG. 2 having a plurality of anti-wear tiles brazed thereon forming one embodiment of a screen cloth of the present invention, where the gap between each tile is less than about 0.5 mm.

FIG. 2 illustrates a screen segment useful in the present invention. In this embodiment, screen segment 122 comprises a metal plate substructure 12 having a perimeter 14 and comprising a plurality of longitudinal ligaments 16 and a plurality of transverse ligaments 18, which together form a grid defining a plurality of openings 17. Screen segment 122 further comprises a plurality of holes 15 on each side of the screen segment 122 for attaching the screen cloth to a vibrating screening device or the like. In this embodiment, a plurality of anti-wear tiles 24 are brazed directly onto the upper or front face of screen segment 122, usually accomplished by using a filler metal with a melting temperature above 450° C. (840° F.), to form a completed screen cloth. FIG. 3A illustrates a portion of such a completed screen cloth. FIG. 3B is an expanded view of the encircled portion 90 of the screen cloth of FIG. 3A showing a plurality of anti-wear tiles 24 that are spaced less than 0.5 mm apart from one another.

Anti-wear tiles 24 are generally made from a hard metal such as cemented or sintered tungsten carbide, chrome carbide, titanium carbide or ceramic. In one embodiment, the anti-wear tiles 24 are square or rectangular in shape and are comprised of about 85 to 91% tungsten carbide. In one embodiment, the anti-wear tiles 24 are about 8 to 12 mm in thickness, however, the anti-wear tiles can be greater than 12 mm in thickness. The anti-wear tiles 24 are spaced less than about 0.5 mm from one another (i.e., thereby forming gaps of less than about 0.5 mm between each tile) such that the filler metal (also referred to herein as brazing (braze) material) fills the gaps, thereby joining each anti-wear tile 24 to its adjacent anti-wear tile 24.

Figure 4:
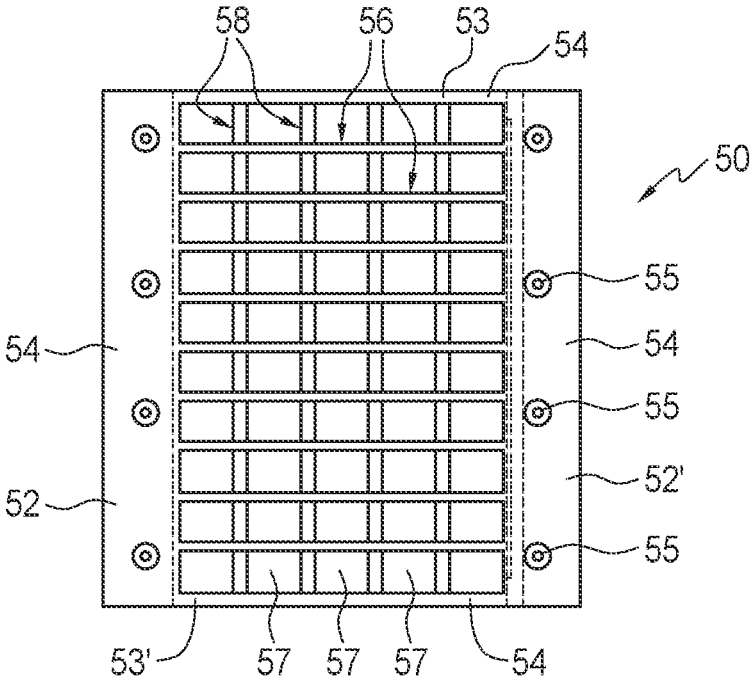
FIG. 4 illustrates one embodiment of a support structure for receiving a plurality of screen segments having a plurality of anti-wear tiles brazed thereon, where the gap between each tile is less than about 0.5 mm.
Figure 5:
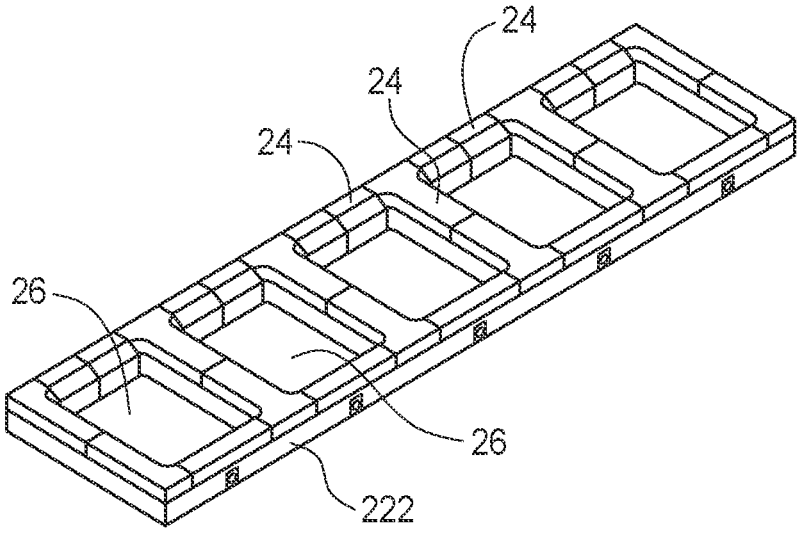
FIG. 5 is a perspective view of one embodiment of a screen segment having a plurality of anti-wear tiles brazed thereon, where the gap between each tile is less than about 0.5 mm, which can be attached to the support structure of FIG. 4.

In one embodiment of the present invention, a screen cloth comprises a support structure, such as shown in FIG. 4. With reference now to FIG. 4, support structure 50 comprises two mutually opposing lateral attachment elements 52, 52' and a plurality of transverse stiffeners 56 extending therebetween. The upper and lower transverse stiffeners 53 and 53', respectively, and the two mutually opposing lateral attachment elements 52, 52' form the perimeter 54 of support structure 50. Support structure 50 further comprises a plurality of longitudinal bars 58 to form a grid defining a plurality of openings 57. Support structure 50 further comprises a plurality of holes 55 in each lateral attachment element 52, 52' for attaching the screen cloth to a vibrating screening device or the like. In this embodiment, a plurality of screen segments 22 having a plurality of anti-wear tiles 24 brazed thereon, as shown in FIG. 5, are attached to the support structure 50 to form the final screen cloth. Each screen segment 222 further comprises a plurality of openings 26, which correspond to openings 57 of support structure 50. Once again, anti-wear tiles 24 are spaced from one another by gaps less than 0.5 mm so that the brazing (braze) material fills the gaps.

The screen segment 222 of FIG. 5 can be attached to the support structure 50 using conventional techniques known in the art such as bolting, gluing or welding. Preferably, a combination of welding and bolting is used.

Figure 6:
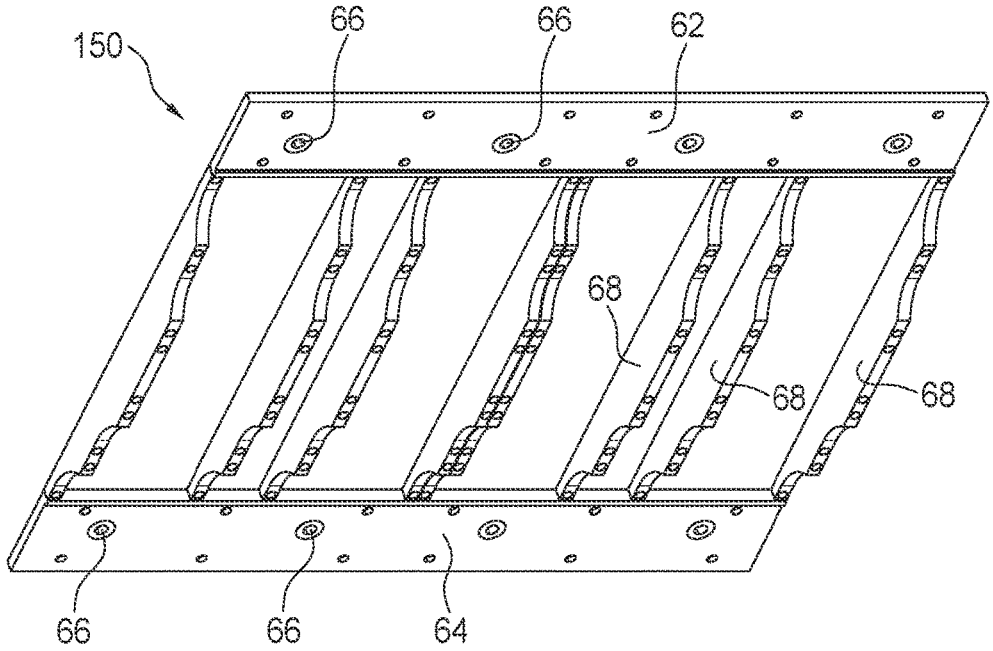
FIG. 6 is a bottom view of another embodiment of a support structure for receiving at least one screen segment having a plurality of anti-wear tiles brazed thereon, where the gap between each anti-wear tile is less than about 0.5 mm.

FIG. 6 illustrates another support structure useful in another embodiment of a screen cloth of the present invention. Support structure 150 comprises two mutually opposing lateral attachment elements, first lateral attachment element 62 and second lateral attachment element 64. Lateral attachment elements 62, 64 have at least one fastening hole 66 drilled therethrough for attaching the lateral attachment elements to, for example, a vibrating screening device's cross beams by means of bolts, screws and the like. In FIG. 6, each lateral attachment element has four fastening holes 66.

Extending between and attached at each end to the first and second lateral attachment elements 62, 64 are a plurality of transverse stiffeners 68. Generally, the transverse stiffeners 68 are attached to the lateral attachment elements 62, 64 by means of welding. Each of the lateral attachment elements and the transverse stiffeners are made of a mild steel, a corrosion resistant steel such as stainless steel. The supporting steel structure forms the base of one embodiment of a screen cloth of the present invention.

Figure 7A:
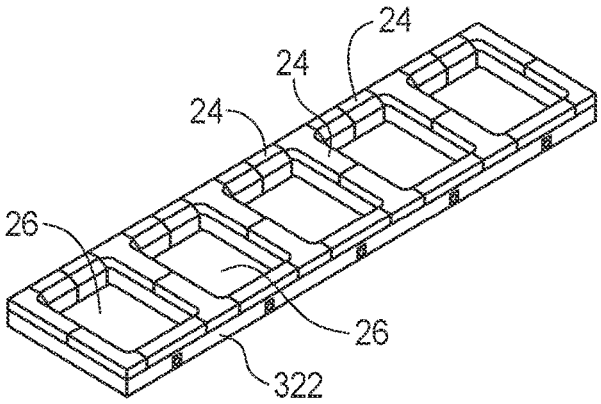
FIGS. 7A and 7B are perspective views of two types of screen segments having a plurality of anti-wear tiles brazed thereon, where the gap between each tile is less than about 0.5 mm, each of which can be attached to the support structure of FIG. 6.

FIG. 7A is a perspective view of a screen segment 322 of the present invention, which can be attached to a support structure such as shown in FIG. 6. Screen segment 322 is generally made of a mild steel, a corrosion resistant steel such as stainless steel having a plurality of screen openings 26, made by plasma cut or machining, therethrough. The screen segment 322 shown in FIG. 7A comprises five such screen openings 26. Attached to the upper surface of base plate 322 are a plurality of anti-wear tiles 24 made from a hard metal such as cemented or sintered tungsten carbide, chrome carbide, titanium carbide or ceramic, which are attached to base plate 22 by brazing, usually accomplished by using a filler metal with a melting temperature above 450° C. (840° F.). In one embodiment, the screen segment 322 is rectangular, 32 mm in thickness and about 175×659 mm in dimension. Once again, anti-wear tiles 24 are spaced apart from one another such that the gap therebetween is less than 0.5 mm and, thereby, the gaps are filled with brazing material through capillary action.

Figure 7B:
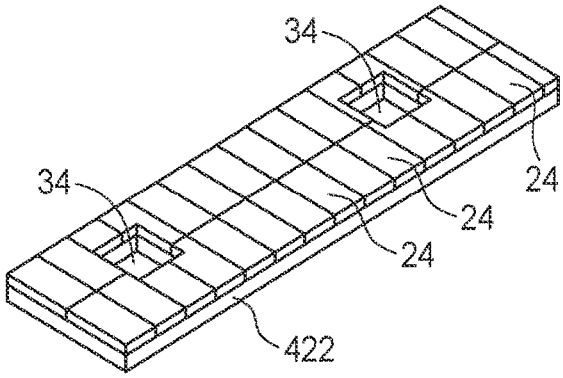

FIG. 7B is a perspective view of another embodiment of a screen segment of the present invention. Screen segment 422 is referred to herein as an "attachment segment", meaning it attaches to the first and second lateral attachment elements 62, 64 as shown in FIG. 6. Each attachment segment 422 is comprised of a base plate, generally made of steel, having a plurality of attachment holes 34 therethrough. The attachment segment of FIG. 7B has two such attachment holes. The attachment holes 34 correspond to fastening holes 66 in supporting structure 150 of FIG. 6. Attached to the upper surface of the base plate are a plurality of anti-wear tiles 24 made from a hard metal such as sintered tungsten carbide, which are attached to base plate by brazing. In one embodiment, the anti-wear tiles 24 are rectangular in shape and are comprised of about 85 to 91% tungsten carbide. In one embodiment, the anti-wear tiles 24 are about 8 to about 12 mm in thickness. It is understood that the anti-wear tiles can be greater than 12 mm in thickness. In one embodiment, the attachment segment 422 is rectangular, 32 mm in thickness and about 175×659 mm in dimension. Once again, anti-wear tiles 24 are spaced apart from one another such that the gap therebetween is less than 0.5 mm and, thereby, the gaps are filled with brazing material.

Figure 8:
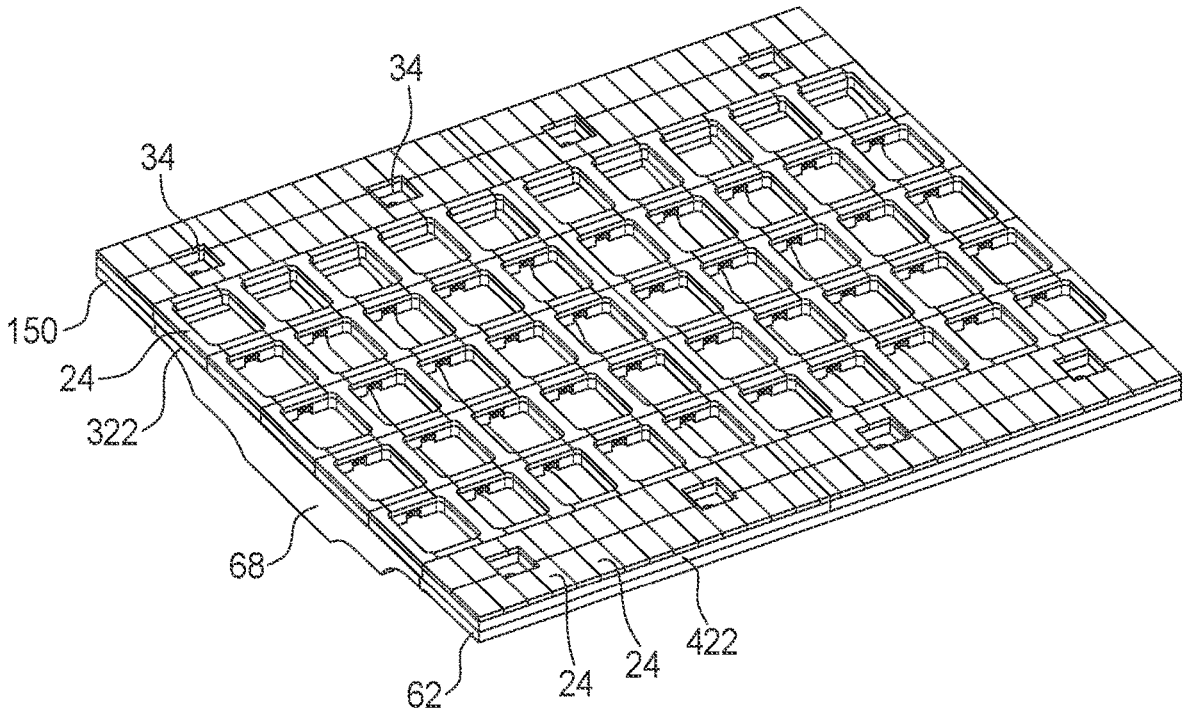
FIG. 8 is a perspective view of a screen cloth of the present invention comprising the support structure of FIG. 6 having a plurality of screen segments of FIGS. 7A and 7B arranged thereon.

FIG. 8 is a perspective view of an embodiment of a completed screen cloth of the present invention using the support structure 150 as shown in FIG. 6, a plurality of screen segments 322 shown in FIG. 7A and a plurality of screen segments 422 shown in FIG. 7B.

The following examples illustrate the advantages of filling gaps between anti-wear tiles with brazing material.

Examples

Materials

The screen cloths tested in this example were comprised of a support structure made of mild steel and its main function is to carry the load to screen supporting beams through long high strength bolts. This support structure carries screen segments of mild or corrosion resistant steel having anti-wear tiles brazed on their flow exposed surface. The connection between the support structure and steel segments is secured through bolting and/or welding. The anti-wear tiles are made of sintered tungsten carbides with tungsten percentage between 85% and 91%. The brazing material used to attach the anti-wear tiles to the steel segments is made of sliver alloy and it is applied at relatively low heat input to protect the hard properties of carbide tiles.

Testing

Figure 9:
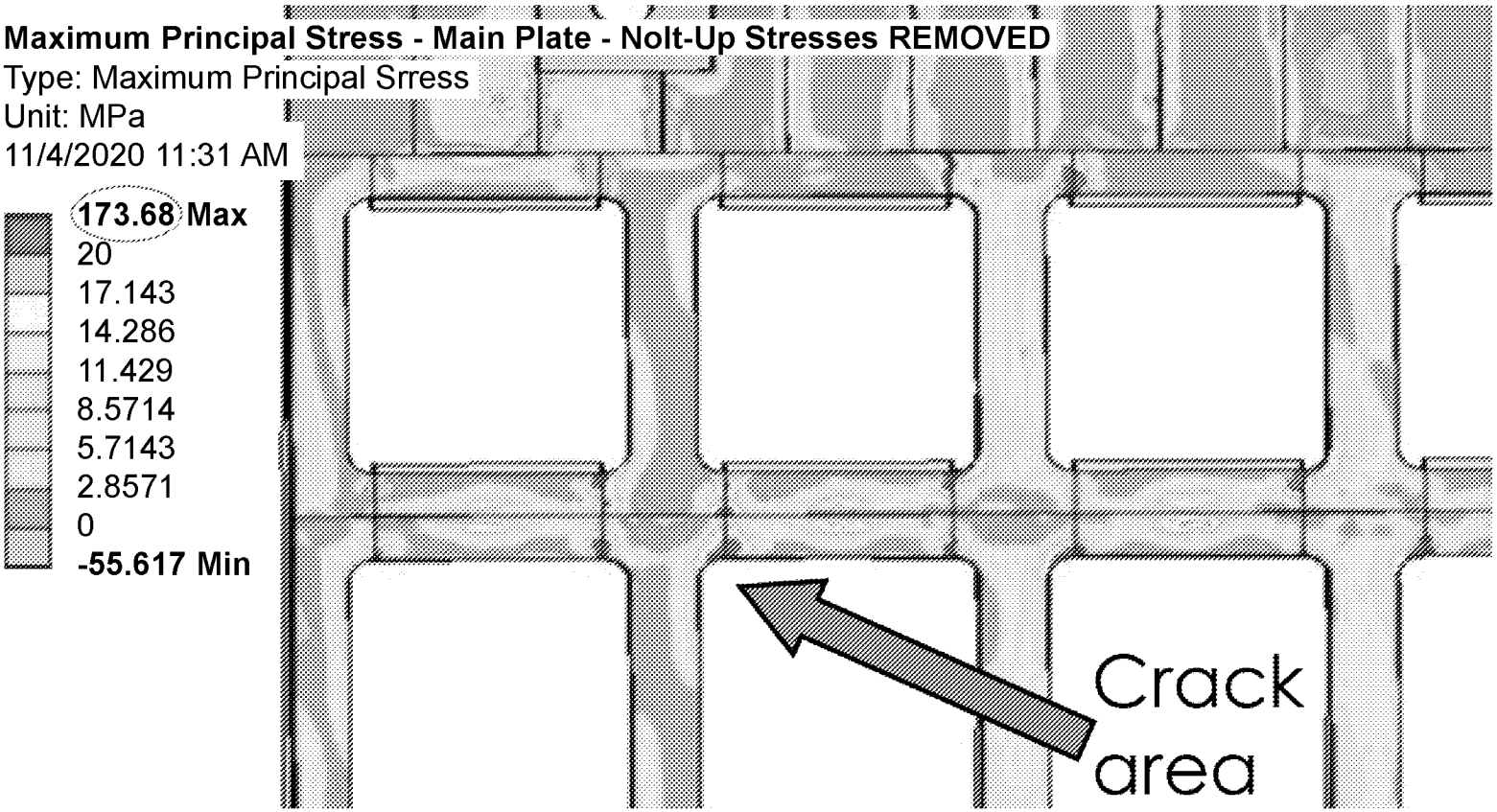
FIG. 9 illustrates the finite element analysis (FEA) results performed on a screen cloth where the gap size between anti-wear tiles was greater than 1 mm.
Figure 10:
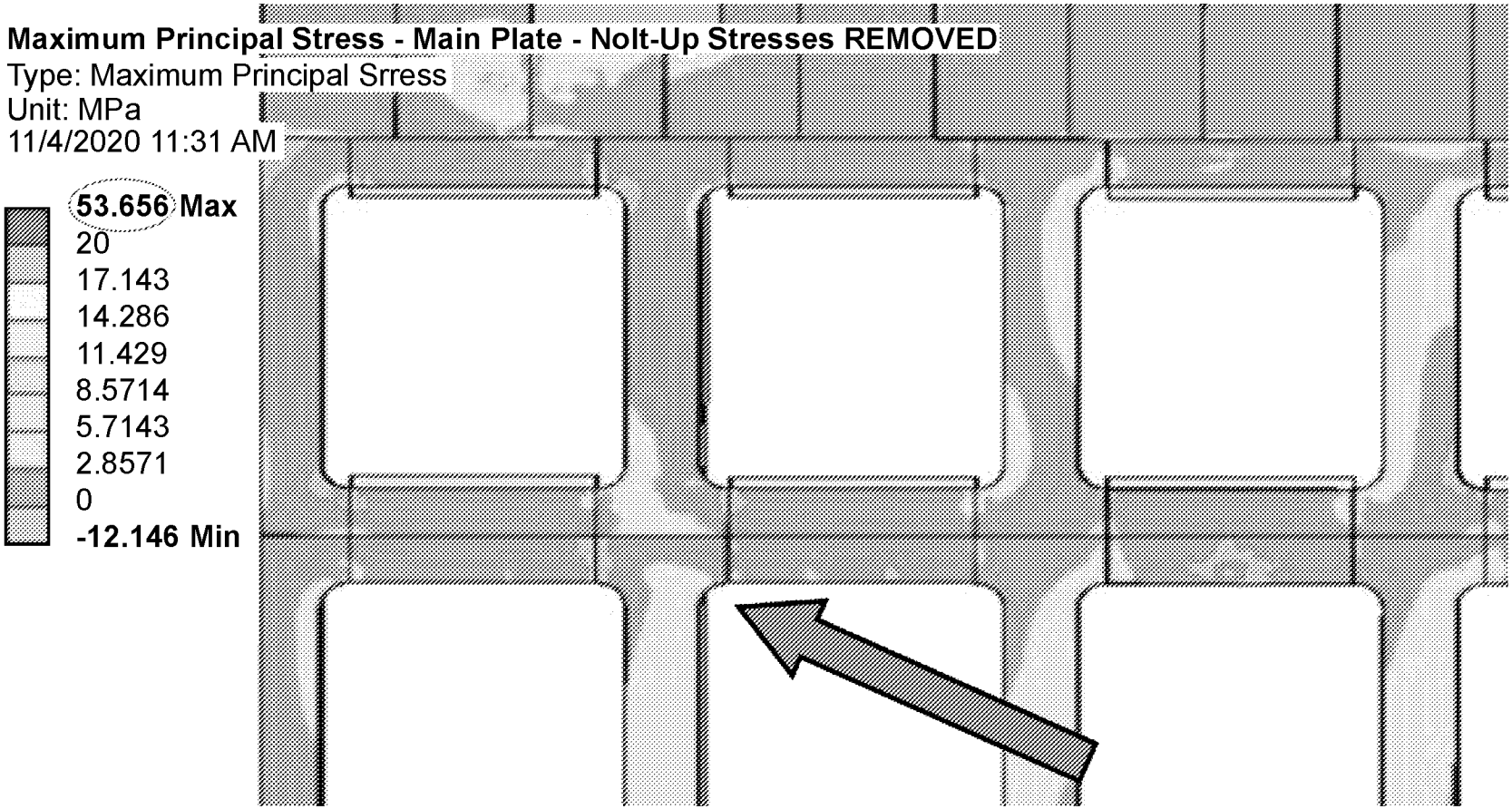
FIG. 10 illustrates the finite element analysis (FEA) results performed on a screen cloth where the gap size between anti-wear tiles was less than 0.5 mm.

Finite element analysis (FEA) was done on two screen cloths: the screen cloth as shown in FIG. 9, where the gap size between anti-wear tiles was greater than 1 mm and therefore unfilled, and the screen cloth as shown in FIG. 10, where the gap size between anti-wear tiles was less than 0.5 mm and therefore the gaps were filled with brazing material. FEA is a computerized method for predicting how a product reacts to real-world forces, vibration, heat, fluid flow, and other physical effects. Finite element analysis shows whether a product will break, wear out, or work the way it was designed. The different colours are indicators of variable values, in this instance, maximum principal stress, measured in MPa.

As can be seen in FIGS. 9 and 10, the screen cloth where the gaps were greater than 1 mm and not filled with brazing material showed higher stress, i.e., 173 MPa, in the gap areas than when the gaps were less than 0.5 mm and filled with brazing material, where the stress was shown to be minimal. Thus, stress analysis showed that there was as much as a 10 time increase in stress concentration with the screen cloth having large gaps (greater than 1 mm) than with the screen cloth having a filled gap of less than 0.5 mm.

Brazing is executed by applying brazed material on flat surface, heating it up to the melting point of brazed material and then placing the anti-wear tiles on top where capillary action fills all the space between the two surfaces. When tiles are close to each other, capillary action pushes the brazed material in between the vertical spaces of the tiles, which in essence connect the tiles to each other in addition to connecting each tile to the steel base. When the gap between tiles is too large, capillary action doesn't take place and the tiles are only attached to steel base but disconnected from each other. This latter arrangement creates discontinuity in stress field and consequently creates stress riser or stress concentration, which, in the presence of high fatigue cycles, causes rapid failure.

Figure 11:
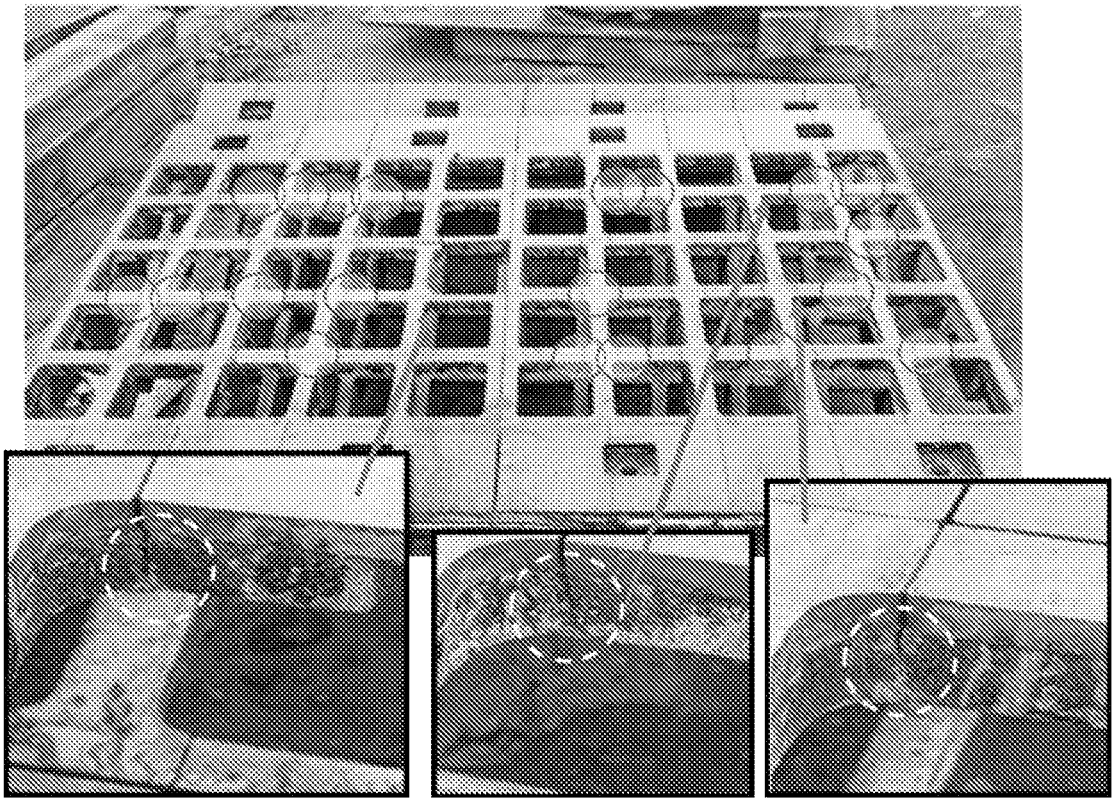
FIG. 11 PRIOR ART
FIG. 11 is a photograph that shows two side-by-side screen cloths where the gaps between the anti-wear tiles measured up to 3.1 mm.

FIG. 11 is a photograph which shows two side by side screen cloths where the gaps between the anti-wear tiles measured up to 3.1 mm. Three areas showed significant cracks that occurred in the steel base of the screen segments directly beneath the gaps between the anti-wear tiles, which gaps were up to 3.1 mm and unfilled. In addition to the stress fatigue, corrosion fatigue was also observed. Thus, failures of the screen cloths with large tile gaps was a result of both high stress and accelerated corrosion, which led to fatigue crack and fatigue corrosion. Thus, in addition to having smaller tile gaps so that the gaps can be filled with brazing material, corrosion resistant steel for the steel base (or apply corrosion protection to the steel base) would also result in longer life for screen cloths.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The scope of the claims should not be limited by the preferred embodiments set forth in the examples, but should be given the broadest interpretation consistent with the description as a whole.

The invention claimed is:

1. A screen cloth for use in a screening device for screening out oversize objects, including oil sands lumps and rocks present in an oil sands slurry, comprising:

at least one screen segment having a top surface and having a plurality of openings therein; and a plurality of anti-wear tiles attached to the top surface of the at least one screen segment by brazing;

whereby each anti-wear tile is separated from an adjacent anti-wear tile by a gap that is 0.5 mm or less such that a brazing material used to attach the anti-wear tiles to the at least one screen segment fills the gap between each anti-wear tile through capillary action thereby connecting each anti-wear tile to its adjacent anti-wear tile.

2. The screen cloth of claim 1, wherein the screen cloth comprises a single screen segment, said screen segment having a perimeter and comprising a plurality of longitudinal ligaments and a plurality of transverse ligaments, the longitudinal and transverse ligaments forming the plurality of openings.

3. The screen cloth of claim 2, wherein the anti-wear tiles are comprised of cemented or sintered tungsten carbide, chrome carbide, titanium carbide or ceramic.

4. The screen cloth of claim 2, wherein the brazing material is an alloy comprising aluminum, silver, copper or nickel, or combinations thereof.

5. The screen cloth of claim 1, further comprising a support structure, the support structure comprising two mutually opposing lateral attachment elements and a plurality of transverse stiffeners extending therebetween, whereby the at least one screen segment is attached to the support structure to form a screening portion of the screen cloth.

6. The screen cloth of claim 5, wherein the anti-wear tiles are comprised of cemented or sintered tungsten carbide, chrome carbide, titanium carbide or ceramic.

7. The screen cloth of claim 5, wherein the brazing material is an alloy comprising aluminum, silver, copper or nickel, or combinations thereof.

8. The screen cloth of claim 1, further comprising a support structure, the support structure comprising a metal plate having a plurality of openings therethrough, whereby the at least one screen segment is attached to a front surface of the metal plate such that the openings of the metal plate and the openings of the at least one screen segment are aligned.

9. The screen cloth of claim 8, wherein the anti-wear tiles are comprised of cemented or sintered tungsten carbide, chrome carbide, titanium carbide or ceramic.

10. The screen cloth of claim 8, wherein the brazing material is an alloy comprising aluminum, silver, copper or nickel, or combinations thereof.

11. The screen cloth of claim 1, wherein the at least one screen segment is cast or forged from carbon steel, low alloy steel, or stainless steel.

12. The screen cloth of claim 11, wherein the anti-wear tiles are comprised of cemented or sintered tungsten carbide, chrome carbide, titanium carbide or ceramic.

13. The screen cloth of claim 1, wherein the anti-wear tiles are comprised of cemented or sintered tungsten carbide, chrome carbide, titanium carbide or ceramic.

14. The screen cloth of claim 13, wherein the anti-wear tiles are comprised of cemented or sintered tungsten carbide.

15. The screen cloth of claim 1, wherein the brazing material is an alloy comprising aluminum, silver, copper or nickel, or combinations thereof.

16. A method for manufacturing a tiled screen segment for a screen cloth for use in a screening device for screening out oversize objects, including oil sands lumps and rocks present in oil sands slurry, comprising:

providing a screen segment having a top surface;

arranging a plurality of anti-wear tiles on the top surface of the screen segment such that each anti-wear tile is separated from an adjacent anti-wear tile by a gap of 0.5 mm or less; and brazing the anti-wear tiles to the top surface of the screen segment such that a brazing material fills the gap between each anti-wear tile gap by capillary action thereby connecting each anti-wear tile to its adjacent anti-wear tile.

17. The method of claim 16, wherein the screen segment is cast or forged from carbon steel, low alloy steel, or stainless steel.

18. The method of claim 17, wherein the brazing material is an alloy comprising aluminum, silver, copper or nickel, or combinations thereof.

19. The method of claim 18, wherein the anti-wear tiles are comprised of cemented or sintered tungsten carbide, chrome carbide, titanium carbide or ceramic.

20. The screen cloth of claim 19, wherein the anti-wear tiles are comprised of cemented or sintered tungsten carbide.

* * * * *